US008790041B2

(12) United States Patent
Bernardoni

(10) Patent No.: US 8,790,041 B2
(45) Date of Patent: Jul. 29, 2014

(54) DEVICE FOR APPLYING A PUSH OR PULL ACTION ON TUBES TO BE LAID UNDERGROUND FOR OVERCOMING WATER COURSES OR OBSTACLE OF OTHER TYPE

(76) Inventor: Roberto Bernardoni, Piacenza (IT)

( * ) Notice: Subject to any disclaimer, the term of this patent is extended or adjusted under 35 U.S.C. 154(b) by 29 days.

(21) Appl. No.: 13/557,565

(22) Filed: Jul. 25, 2012

(65) Prior Publication Data

US 2014/0030025 A1 Jan. 30, 2014

(51) Int. Cl.
*F16L 1/028* (2006.01)

(52) U.S. Cl.
USPC ..... 405/184; 405/174; 405/184.1; 405/184.4; 405/184.5; 254/29 R

(58) Field of Classification Search
CPC ..... E21B 7/046; E21B 19/086; E21B 7/20; E21B 19/155; E21B 7/205; E21B 15/04
USPC ..... 405/174, 183.5, 184, 184.1–184.5; 254/29 R, 93 R, 93 L; 29/238, 252, 29/281.1
See application file for complete search history.

(56) References Cited

U.S. PATENT DOCUMENTS 3,951,216 A * 4/1976 Crawshay et al. ..... 173/32
7,942,609 B2 * 5/2011 Koegler ..... 405/184

FOREIGN PATENT DOCUMENTS

GB 1352706 * 5/1974 ..... B21C 9/00
JP 2008-121356 * 5/2008 ..... B21D 9/08

OTHER PUBLICATIONS www.herrenknecht.com.*
Peters, M., "Direct Pipe: Latest Innovation in Pipeline Construction Technology and References", Pipeline Technology Conference 2008, pp. 1-8.*
Werner Suhm, "Herrenknecht Direct Pipe: One-Pass Pipeline Installation Geologies", IPLOCA Convention 2009, slides 1-15.*

* cited by examiner

*Primary Examiner* — Sunil Singh
*Assistant Examiner* — Carib Oquendo
(74) *Attorney, Agent, or Firm* — Young & Thompson

(57) ABSTRACT

Device (1) for applying a push or pull action on tubes (100) to be laid in the ground for overcoming waterways or other types of obstacle, includes two push blocks (2, 2'), disposed parallel to and mirroring each other, and a vice (8), which couples the device (1) to a tube (100) to be pushed/pulled. Each push block (2, 2') including, in turn, a base (5, 5'), a main cylinder (3, 3'), a movable arm (6, 6'), one positioning cylinder (4, 4') and vertical regulation cylinder (7, 7'). The arms (6, 6') conferring a variable geometry to device (1) which is able to assume corresponding positions and positive and negative angles. The device finds application in the field of ancillary equipment for horizontal controlled drilling and horizontal directional drilling (TOC and HDD), i.e. suitable technologies for installing new pipelines without opencast digging.

7 Claims, 13 Drawing Sheets

DEVICE FOR APPLYING A PUSH OR PULL ACTION ON TUBES TO BE LAID UNDERGROUND FOR OVERCOMING WATER COURSES OR OBSTACLE OF OTHER TYPE

FIELD OF APPLICATION OF THE INVENTION

The present invention finds application in the field of ancillary equipment for horizontal controlled drilling and horizontal directional drilling (TOC and HDD), i.e. suitable technologies for installing new pipelines without opencast excavation.

In particular, the device according to present invention forms part of auxiliary push and pull equipment installed from a hole intended for extremely long and/or relatively large diameter pipelines. They are, therefore, installed from the launching side, and are suitable to push or pull the tube/pipe to be inserted in the hole previously made, for example, by means of conventional RIG (horizontal controlled drilling machines).

STATE OF THE ART

The prior art employs equipment known under the name "Pipe Thruster", Herrenknecht AG Co. (http://www.herrenknecht.com/process-technology/research-development/pipe-thruster.html), made up of two thrust blocks disposed parallel to each other and parallel to the push/pull force direction, each having a substantially trapezoidal base, having fixed geometry, to which, in a fixed hinge point, a main cylinder is hinged to, which, by using a positioning cylinder, in turn, hinged, on one side, to the main cylinder and, on the other, to the base, is able to assume positions between 5° and 15°.

Coupled to the stem of the two main cylinders is a vice which is tightened around the tube to be inserted in the drilled hole.

Said vice consists of four sectors which, urged against the tube external surface by a plurality of small cylinders, function as braking shoe.

The above mentioned bases are enclosed in two sheet piles that prevent horizontal displacement thereof, in the direction of the pulling/pushing force.

It has to be noticed, as already mentioned, that said "Pipe Thruster" has a fixed geometry, which considerably restricts the arc of action of main cylinder)(5°-15°, moreover, not even allowing negative angles. In fact, it exhibits a completely fixed structure, and main cylinders rotate about hinge points integral with the bases, and therefore fixed.

In addition to this, positioning cylinders do not have a high degree of freedom as they are hinged to fixed structures, that is, to the thrust blocks base.

DISCLOSURE AND ADVANTAGES OF THE INVENTION

Object of the present invention is to obviate to the above shortcoming providing a device having variable geometry which is able to impart the main cylinders, and consequently to the tube to be pushed/pulled, angles from −20° to +90°.

A first advantage, hence, is indeed to have a variable geometry allowing optimal positioning and multiple adjustments of the tubes to be pulled/pushed. Said variable geometry is obtained by no longer employing a fixed structure, as in the prior art arrangements, but a movable one.

The machine has innumerable variable angles combined with innumerable variable elevations.

Therefore, the substantial difference between the device according to the invention and the "Pipe Thruster" is having a movable arm, pivoted on base in one point, for each thrusting block, carrying not only main cylinder (which in the "Pipe Thruster" is supported by the base), but also the positioning cylinder, increasing the number of position the main cylinder can occupy.

Moreover, the device is suitable for a number of applications, ranging from conventional RIGs during TOC drilling, to a rescue device for recovering tubes stuck in the ground, and device DIRECT PIPE® (Trademark registered by HERRENKNECHT AG) for directly inserting the tube during horizontal drillings.

Another advantage is the possibility of inserting the tube in previously built tunnels.

In addition to the above advantages, by employing a thrust ring associated with a rail, in place of the vice, even concrete tubes with diameters larger than three meters can be laid.

Said objects and advantages are all achieved by the device for applying a push or pull action on tubes to be laid in the ground for overcoming water courses or other types of obstacles, object of the present invention, characterized by what provided in appended claims below.

BRIEF DESCRIPTION OF THE FIGURES

This and other features will become more apparent from the following description of a number of embodiments shown, as a simplifying and non-limiting example, in the enclosed drawings.

DESCRIPTION OF THE INVENTION

Particularly referring to the figures, a device for applying a push or pull action (referred to as "push/pull" in technical terminology) on tubes 100 to be laid in the ground for overcoming water courses or other types of obstacles.

First Exemplary Embodiment

Figure 1:
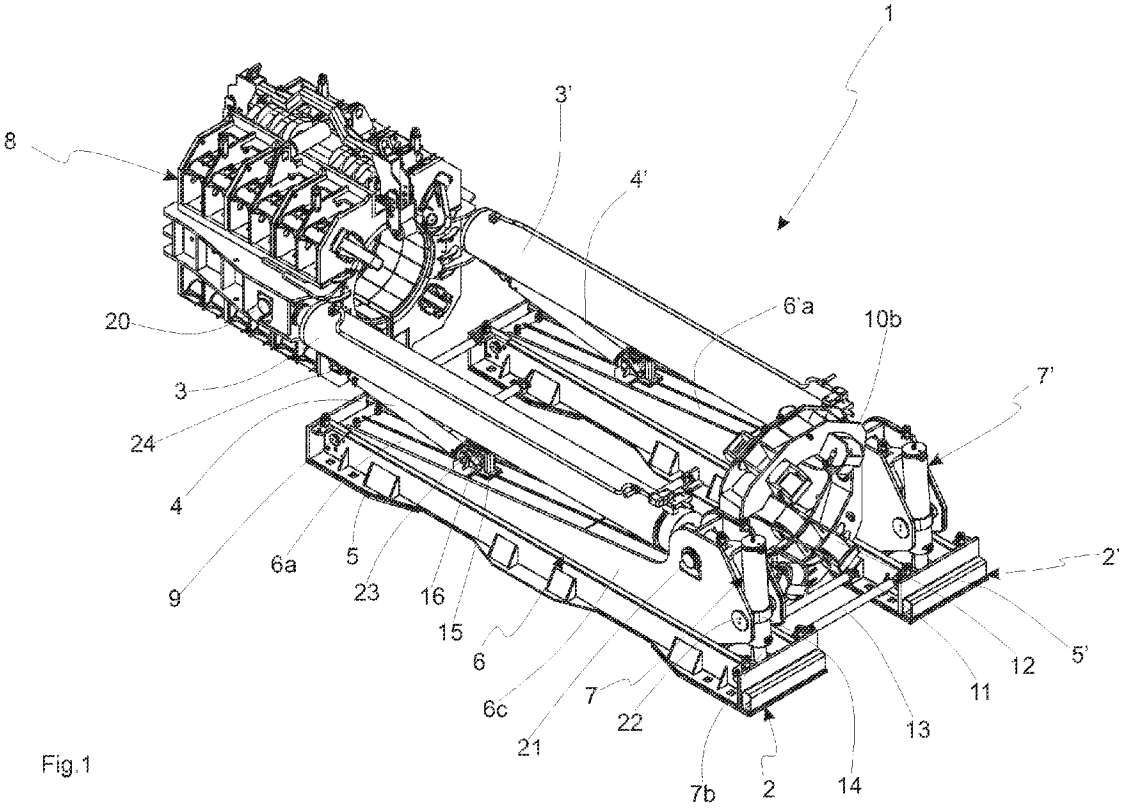
FIG. 1: shows a perspective view of the device for applying pushing or pulling action on tubes to be laid in the ground.
Figure 2:
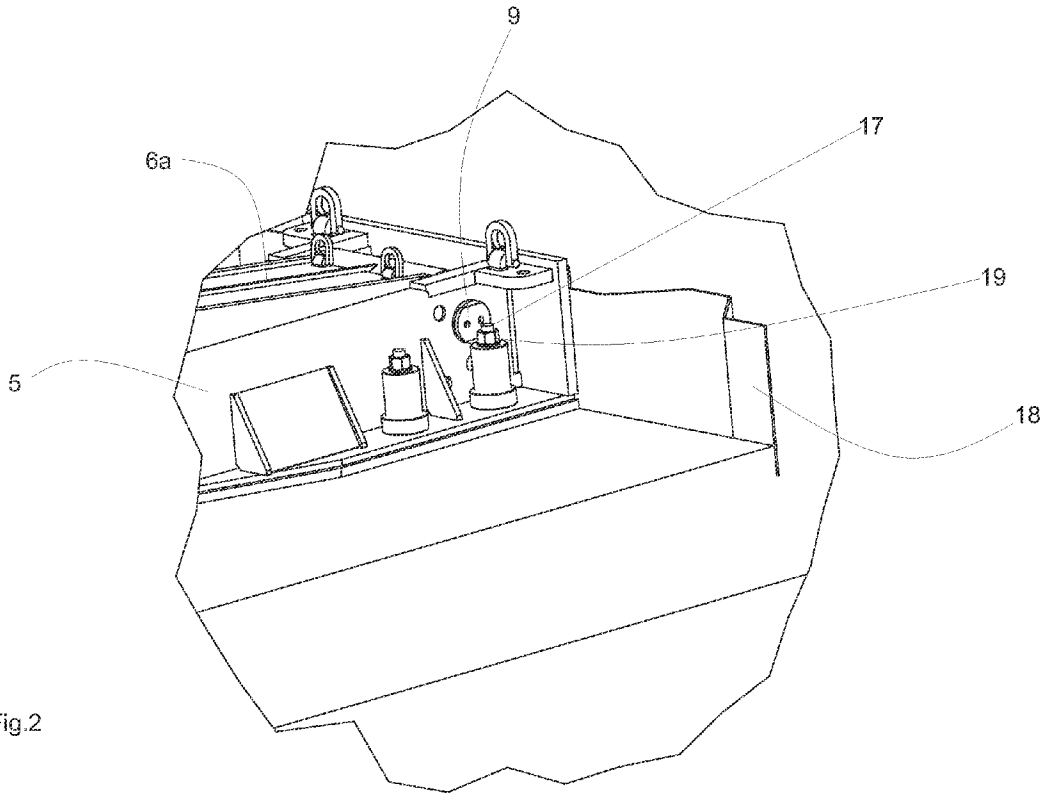
FIG. 2: shows a detail of the device according to the present invention.
Figure 3:
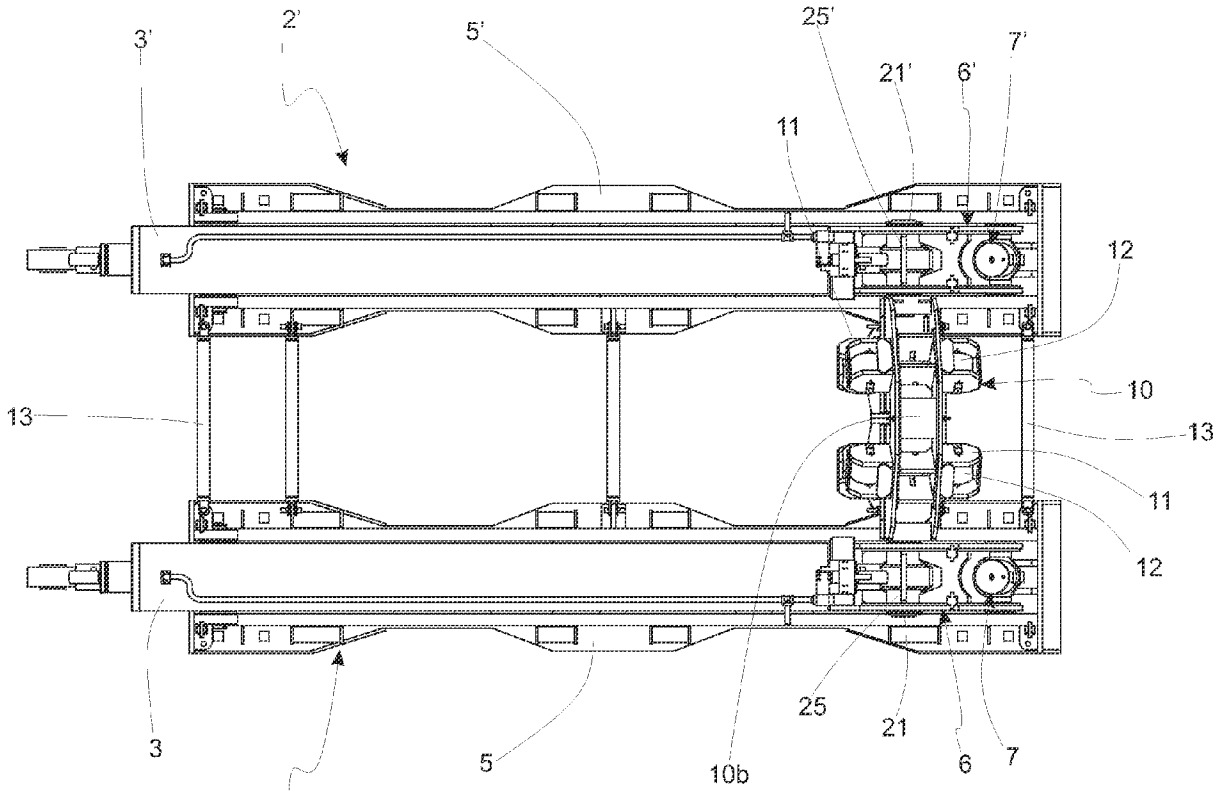
FIG. 3: shows a top view of part of the device in FIG. 1.

In a first exemplary embodiment, said device 1 comprises two push blocks 2 and 2', disposed parallel to and mirroring each other, and a vice 8, of known type, which couples the whole device 1 to a tube 100 to be pushed/pulled (FIG. 1).

Since said thrust blocks 2, 2' are completely identical, hereinafter, for clarity, only one of the two will be referred to.

A thrust block generally comprises:

a base 5 to which a movable arm 6 is hinged;

a main cylinder 3, hinged, on the bottom side, to the above mentioned arm 6, carrying out a pushing/pulling action on tube 100;

a positioning cylinder 4, smaller in size than the foregoing, located between main cylinder 3 and arm 6, and hinged thereto in two hinge points 24 and 23, respectively, having the function to assist in coupling cylinder 3 to vice 8, previously positioned with a hinge pin 20; it further has the function of self-balancing the horizontal axis of vice 8;

a vertical adjustment cylinder 7, hinged to base 5 and arm 6, which actuates arm 6 itself, aligning the work axis, and, thereby applying a force T to the excavation axis.

As shown in the figures, base 5 is substantially bin-shaped and has, on one of the ends, two through holes, mirroring each other, supporting a pin 9, on which arm 6 engages, and about which it is free to rotate.

Device 1 according to the present invention features the above mentioned arm 6 which, together with possible adjustments of cylinders 3, 4 and 7, achieved by varying expansions thereof, provide the device 1 with the possibility of a variable geometry, and the possibility to employ different work axis.

Arm 6 is essentially box-like and L-shaped, i.e. formed of two bases, an upper 6*a* and a lower base 6*b*, and of two parallel side plates 6*c* and 6*d*. Its vertical axis is an important variable of the system since, based on size and desired performance of device 1, it is determined and fixed during the designing step.

Figure 5:
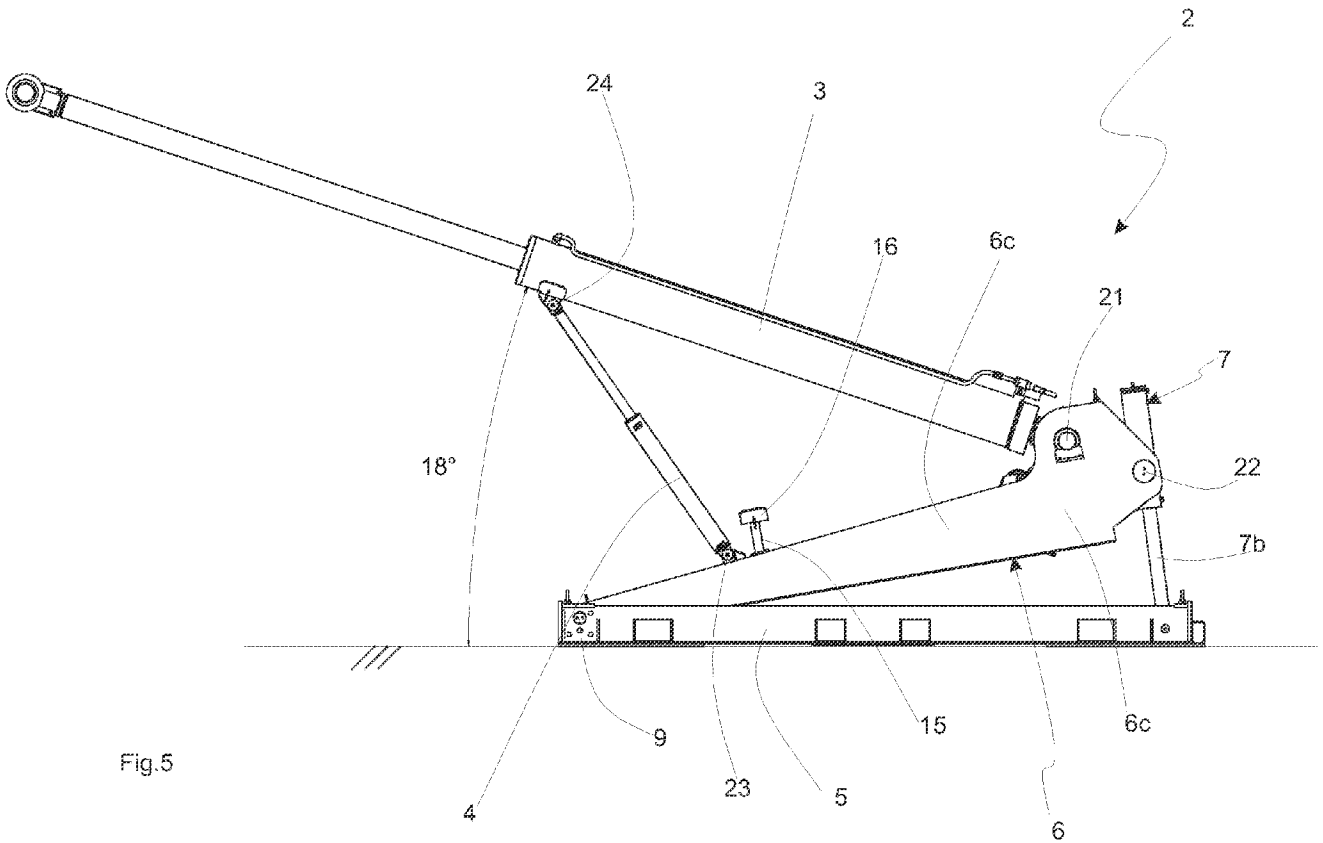
FIGS. 5 and 6: show in elevation a thrust block in a position corresponding to a positive angle.
Figure 6:
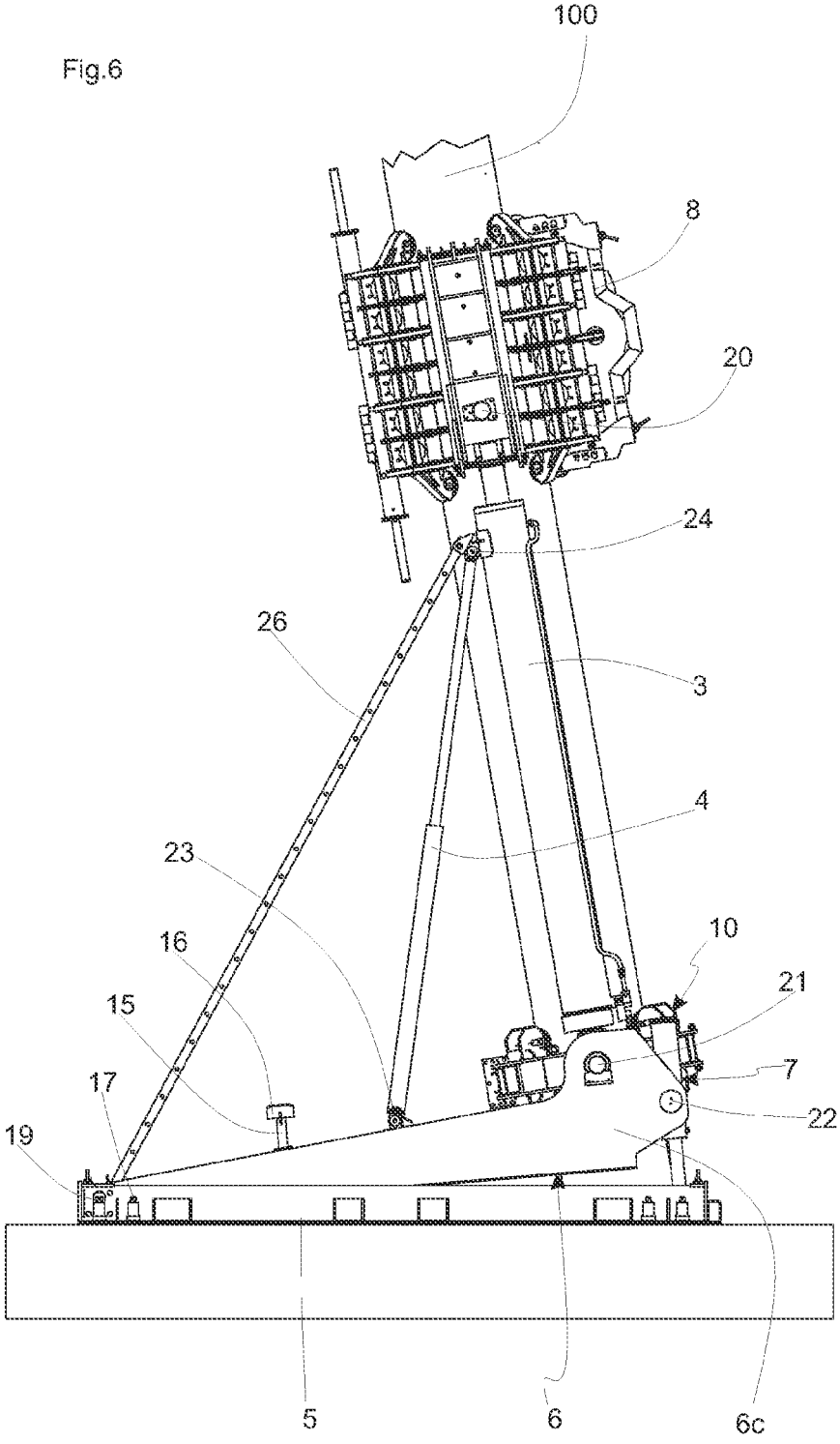
Figure 7:
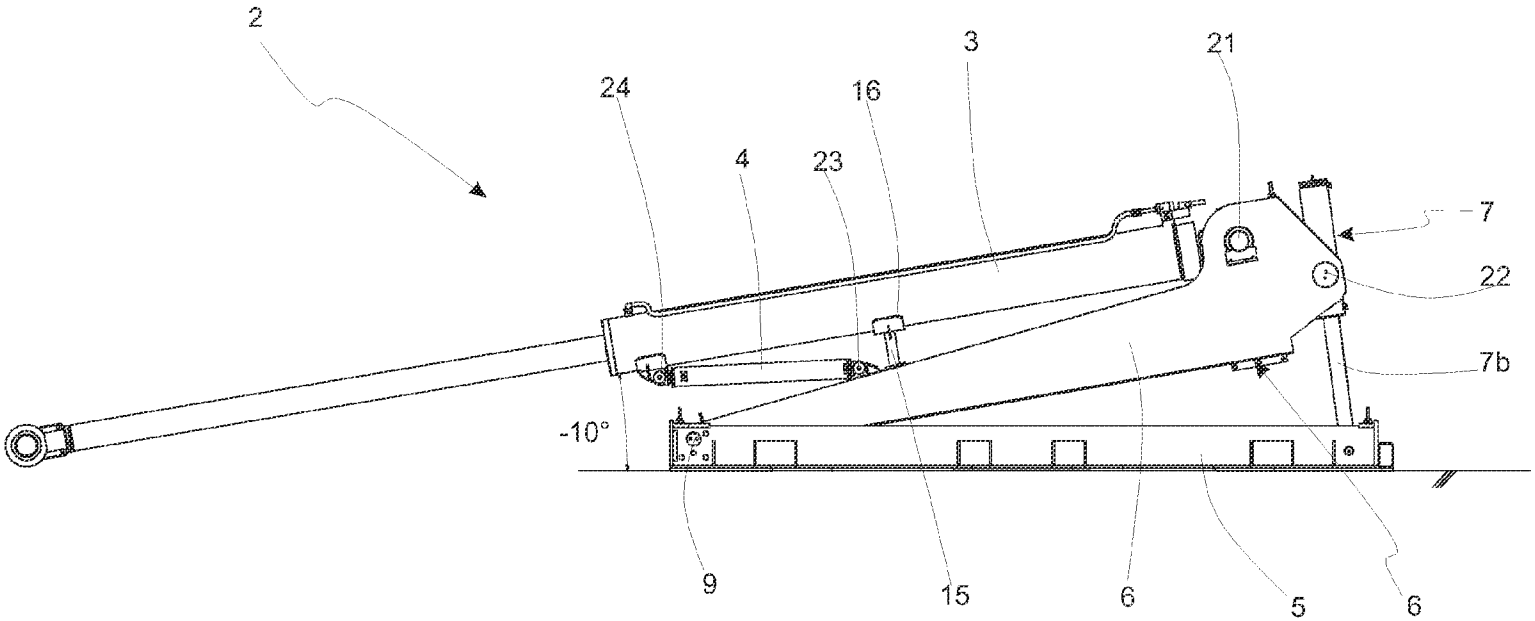
FIG. 7: shows in elevation thrust block of FIG. 5 in a position corresponding to a negative angle.

As well shown in FIG. 5, at the end of said arm 6 short side, at a hinge point 21 on each one of the two side plates 6*c* and 6*d*, the bottom of cylinder 3 is hinged by a pull pin 25.

Two hooks, secured to the side plates 6*c* e 6*d*, at the opposite end with respect to pin 9, are indicated at 22. A containment band 14 is fixed to said hooks 22 which is suitable to attach jacket 7*b* of vertical adjustment cylinder 7 to arm 6 itself. Stem 7*b* of said cylinder 7, instead, is secured to base 5.

At about ⅓ of the length of upper base 6*a* of arm 6, positioning cylinder is hinged at a hinge point 23. At said hinge point 23 there is also a vertical rod 15 carrying a cradle plate 16 on which cylinder 3 abuts during transport.

It is to be noticed that, depending on the desired work angle, in the designing step, changing the position of positioning cylinder 4 moving its hinge point 23 along upper base 6*a* of arm 6 is possible. In fact, the closer said hinge point 23 gets to hinge point 21 of main cylinder 3 on the end of arm 6, the more the work angle tends to 90°.

Between the two push blocks 2 and 2', fixed to sides 6*d* and 6*d'* of arms 6 and 6' in hinge points 21 and 21', there is an opposing roller 10, disposed orthogonally with respect to the longitudinal axis of base 5 and 5' and having a substantially circular shape, suitable to accommodate tube 100 to push/pull.

Figure 4:
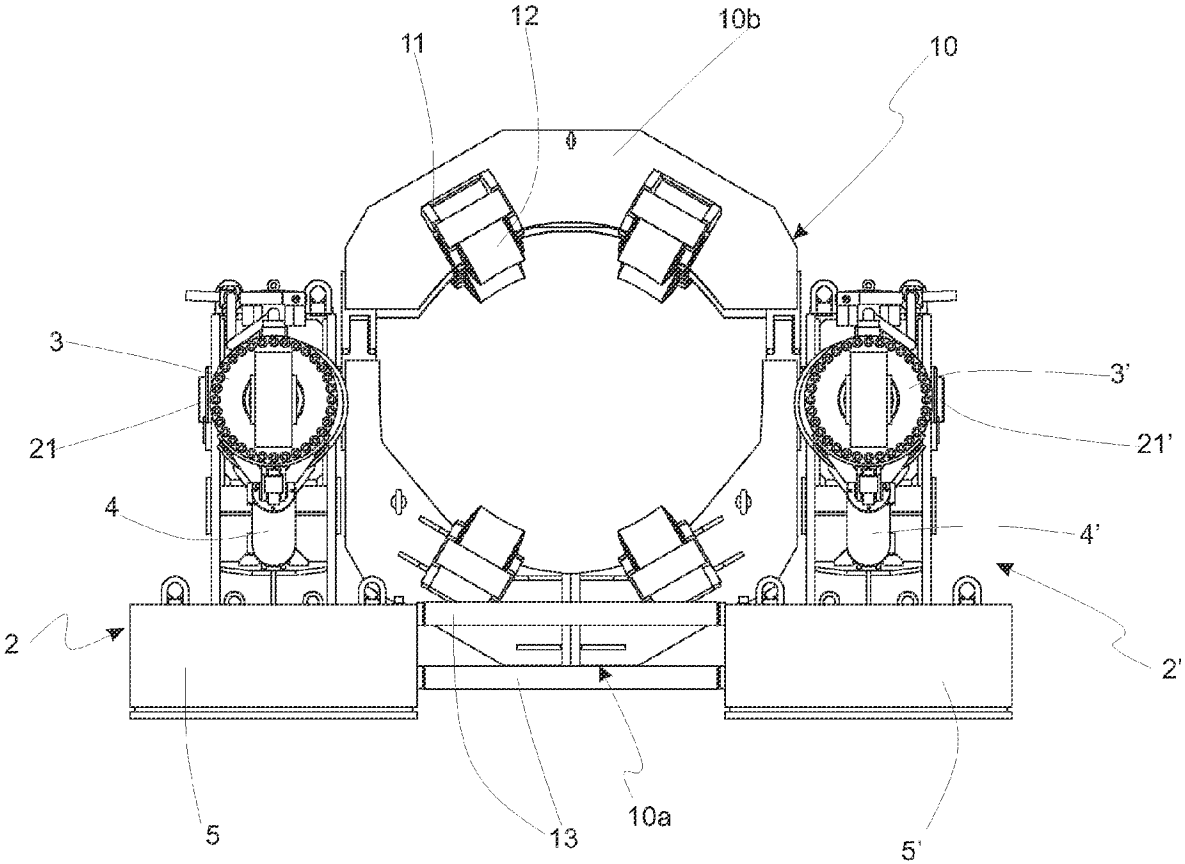
FIG. 4: shows an elevation front view of the detail in FIG. 3.

As shown in FIG. 4, said opposing roller 10 is formed of a lower opposing half-roller 10*a* and an upper one 10*b*. Lower opposing half-roller 10*a*, in turn, consists of two portions, linked to one another through centering pins and bolts (not shown in the figures), and is coupled to pull pins 25 and 25' of main cylinders 3 by means of radial ball bearings.

Upper half-roller 10*b*, made in one piece and also hinged on the same axis of main cylinder 3, is coupled to said lower half-roller 10*a*.

Said roller 10 is fabricated in two half rollers 10*a* and 10*b* to facilitate mounting of push blocks 2 and 2' in the case where tube 100 is already present and with predefined insertion angle.

To facilitate sliding of tube 100 to be laid, on the inner surface of said half-rollers 10*a* and 10*b* there are cantilevered structures 11, parallel to bases 5 and 5' axis, containing rollers 12 (in the example two structures 11 are shown for each half-roller 10*a* and 10*b*, carrying two rollers 12. By means of said rollers 12, and in virtue of the fact that it can swing around pull pins 25 and 25' of main cylinders 3 through the bearings, said opposing roller 10 is able to perfectly adapt to the geometry and inclination of tube 100 to be laid.

A plurality of crosspieces (five in the example) which couple bases 5 and 5' connecting the sides of the same are indicated at 13.

In the following, installation steps and operation of device 1 for applying a pulling or pushing action on tubes 100 to be laid in the ground for overcoming water courses or other type of obstacles will be described.

Assuming, for example, carrying out a controlled horizontal drilling (TOC) is desired.

After making the pilot hole, boring and cleaning the hole, routine TOC procedures, installation of device 1 is carried out on the insertion side of tube 100 to be inserted.

First of all, a concrete platform is formed, on which device 1 according to the present invention is then installed. As the size of tube 100 and the stroke of stems 7*b* and 7'*b* of vertical adjustment cylinders 7 and 7' vary, positioning of said platform can change as circumstances require.

Taking into account device 1 external dimensions, next to the concrete platform, sheet piles 18 are set into the ground which, in the push/pull step of device 1, produce counteracting forces on bases 5 and 5'.

Then, to secure device 1 to the ground, threaded bars 17 are employed serving as stay rods, an end of which is buried in the concrete, and the other is secured to bases 5 and 5' by means of threaded nuts 19. Said threaded bars 17 are required to be able to discharge to the ground compression and traction forces generating during pulling and pushing steps, respectively.

At this point, a first complete push block 2 is positioned. This operation is carried out taking into account the digging axis of the TOC. Next, second complete push block 2' is positioned.

It has to be noted that said push blocks 2 and 2' are placed on the ground in the smallest overall dimensions configuration, that is, with an opening angle of main cylinder 3 of 0°. Then, through the use of positioning cylinders 4 and 4' and vertical adjustment cylinders 7 and 7', the abovementioned push blocks 2 and 2' will adapt to specific work conditions.

In fact, cylinders 7 and 7', abutting against roller 10, previously adjusted for tube 100 to be inserted, automatically align pins 21 and 21' with the insertion axis.

Once push blocks 2 and 2' are housed, bases 5 and 5' connected to one another, at first through crosspieces 13, and then by inserting lower opposing half-roller 10*a*.

Using tube-laying cranes and tractors ("sideboom" for those skilled in the art), tube 100 is placed between the two push blocks 2 and 2' on lower half-roller 10*a*. In doing so, its axis is aligned with the excavation axis and one of the two ends thereof is positioned in proximity of the insertion hole in the ground, maintaining, by virtue of device 1 according to the present invention, the predetermined angle of insertion.

Specifically, by means of positioning cylinders 4 and 4' and vertical adjustment cylinders 7 and 7', the two main cylinders 3 and 3' are aligned with the axis of tube 100.

At this time the known type vice 8 is inserted on tube 100 and carries out its blocking action on said tube 100 through a plurality of hydraulic cylinders.

The weight of vice 8, once said vice is hoisted on tube 100 by means of a supporting crane, bears totally on tube 100 itself.

In accordance with the preferred embodiment shown in the appended figures, the stems of main cylinders 3 and 3' are extended until they reach vice 8 and coupled thereto by locking pins 20.

At this time, insertion of tube 100 can begin by pushing/pulling main cylinders 3 and 3'.

Operatively, during tube 100 pulling step (PULL), force T generated by main cylinders 3 and 3' for insertion of tube 100 is converted in a series of forces F0, F1, Fa, Fb and Fc acting on the entire structure of device 1.

To make it simpler, T is opposed by force Fa generated owing to base 5 resting on sheet piles 18. Forces Fb and Fc exert a radial compression depending on angle $\alpha$. Force F0 is the only weight force without any compressive component.

Figure 11:
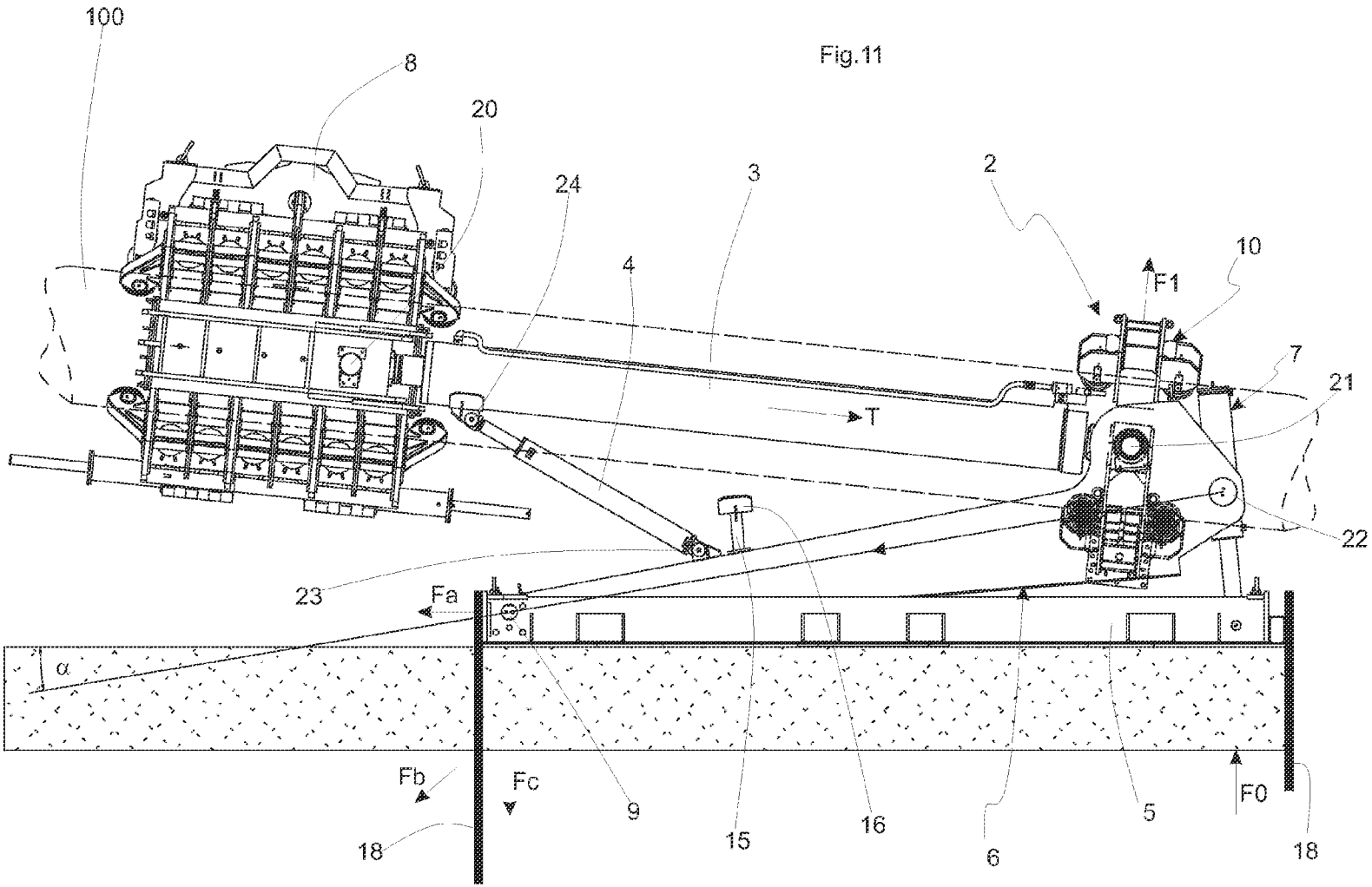
FIG. 11: shows the device in pulling mode ("PULL") and the forces exerted on its structure.

In FIG. 11, the arrangement of the above forces on push block 2 is shown. It can be seen that lower half-roller 10*a* always exerts a force orthogonal to the axis of tube 100, considerably limiting the influence of other forces involved. In particular, said force F1 is controlled by vertical adjustment cylinder 7.

Figure 10:
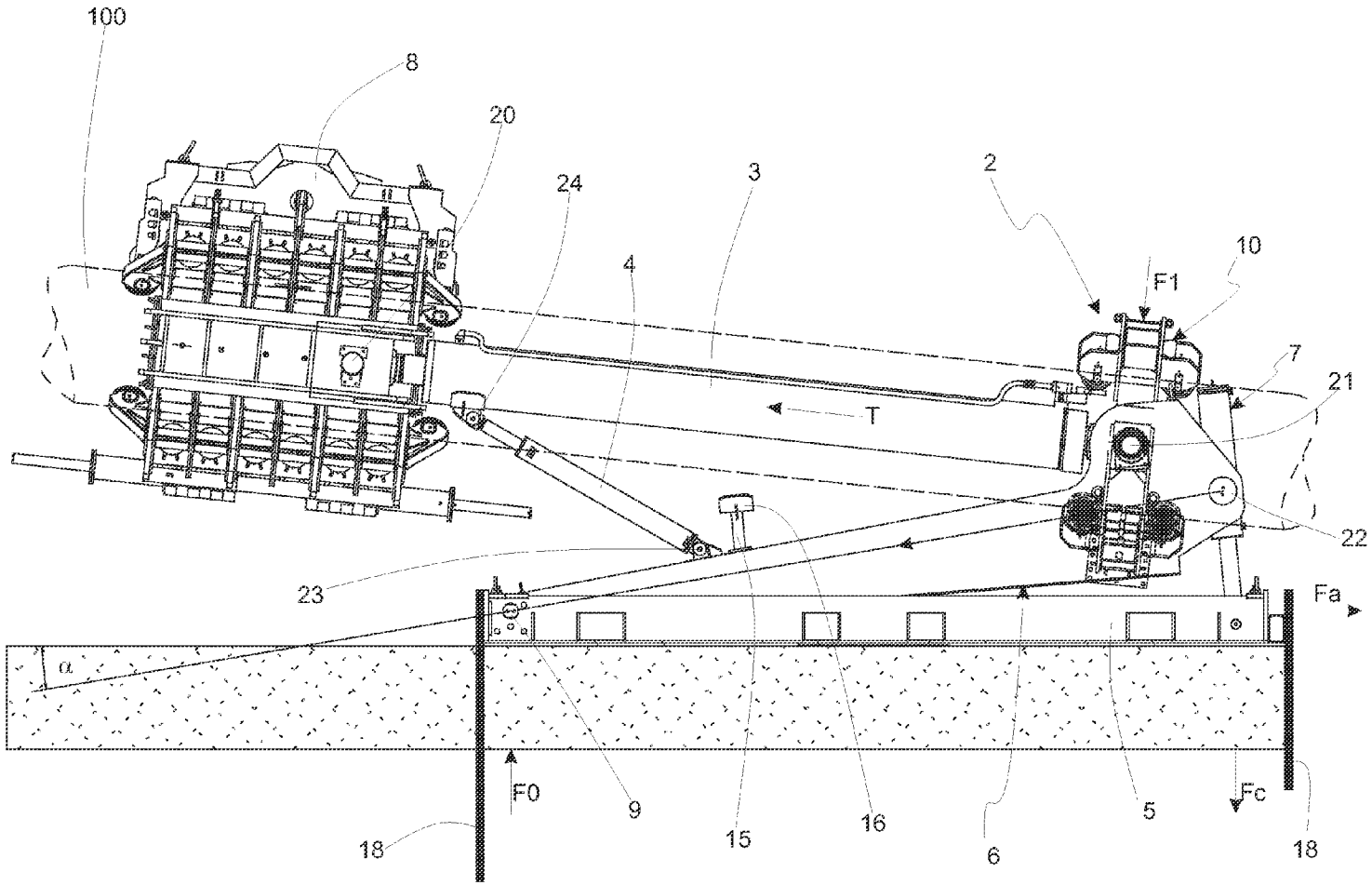
FIG. 10: shows the device in pushing mode ("PUSH") and the forces exerted on its structure.

Also during the pushing step (PUSH) of tube 100, force T is translated in a series of forces F0, F1, Fa and Fc acting on the whole structure of device 1 (FIG. 10). In this step, to limit the influence of said forces on push block 2 and 2', and consequently on the ground, the complete opposing roller 10 is used, that is both lower half-roller 10*a* and upper half-roller 10*b*. In this case, then, upper half-roller 10*b* opposes a force F1 perpendicular to the axis of tube 100, limiting the effects of other forces acting on the system.

Also in this case, in a simplifying manner, referring to push block 2, force T is opposed by force Fa generating from base 5 resting on sheet piles 18. Force Fb is null.

By employing vertical adjustment cylinder 7, compression load of upper half-roller 10*b* can be controlled. In this case, compression forces Fc are generated, and upward force F0 could have a small compression component due leverages acting on hinge point 21.

It can be seen in the appended figures how this configuration (pushing step) is more convenient for the compression load forces exerted on the concrete platform.

In both cases, pulling step (PULL) and pushing step (PUSH), it can be observed, however, that compressions on the ground are not excessive, above all if compared to those produced in the "Pipe Thruster" equipment. Moreover, it is understood how important opposing rollers 10 and 10' are, tangentially opposing to the pushing or pulling paths of main cylinders 3 and 3'.

Figure 8:
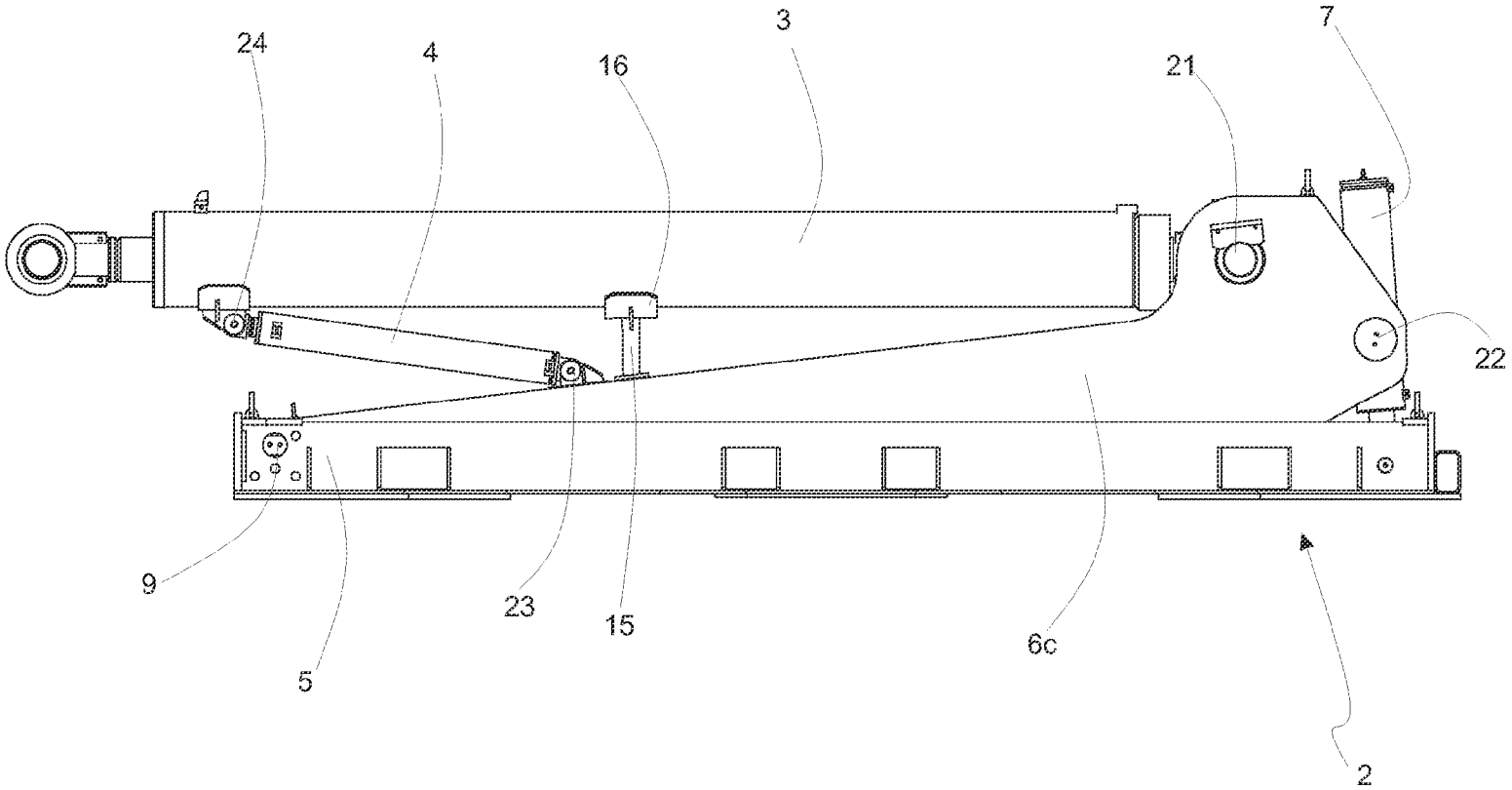
FIG. 8: shows in elevation thrust block of FIG. 5 in a position corresponding to a 0° angle.
Figure 9:
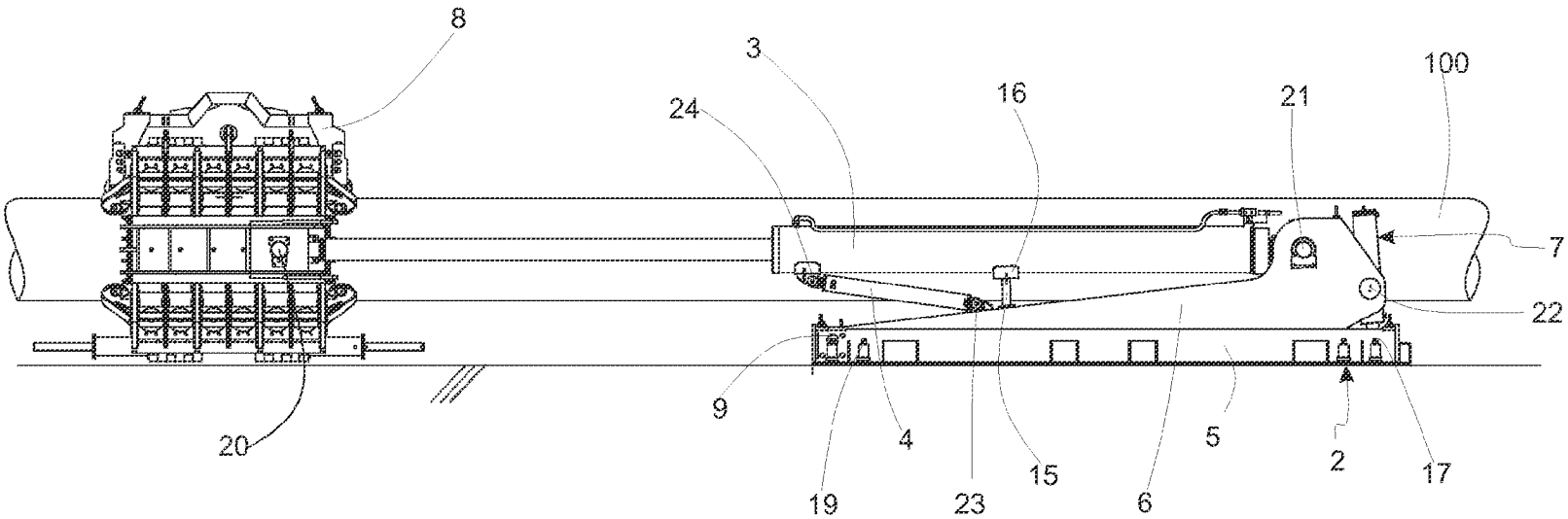
FIG. 9: shows the device according to the present invention with a tube to be pushed/pulled inserted therein.

In FIGS. 5, 6, 7 and 8 various examples of strokes reachable by main cylinder 3 and 3', by adjusting positioning cylinders 4 and 4' and vertical adjustment cylinders 7 and 7'. In particular, it has to be noticed that, having a variable geometry, not only pushing/pulling tube 100 with an opening angle of device 1 of 0° (parallel to the ground as shown in FIG. 8) is possible, but also covering negative angles (FIG. 7), characterizing feature of device 1 according to the present invention.

In case device 1 is employed achieve working angles close to 90° (FIG. 6), the system can be blocked by means of two rods 26 and 26' (one for each push block 2 and 2') introducible between upper bases 6*a* and 6'*a* of arms 6 and 6' and push cylinders 3, 3'.

According to a possible alternative embodiment (not shown in the figures), device 1 can provide vertical adjustment means in place of cylinder 7 and 7', falling however within the inventive scope defined in the appended claims below.

Second Exemplary Embodiment

Figure 12:
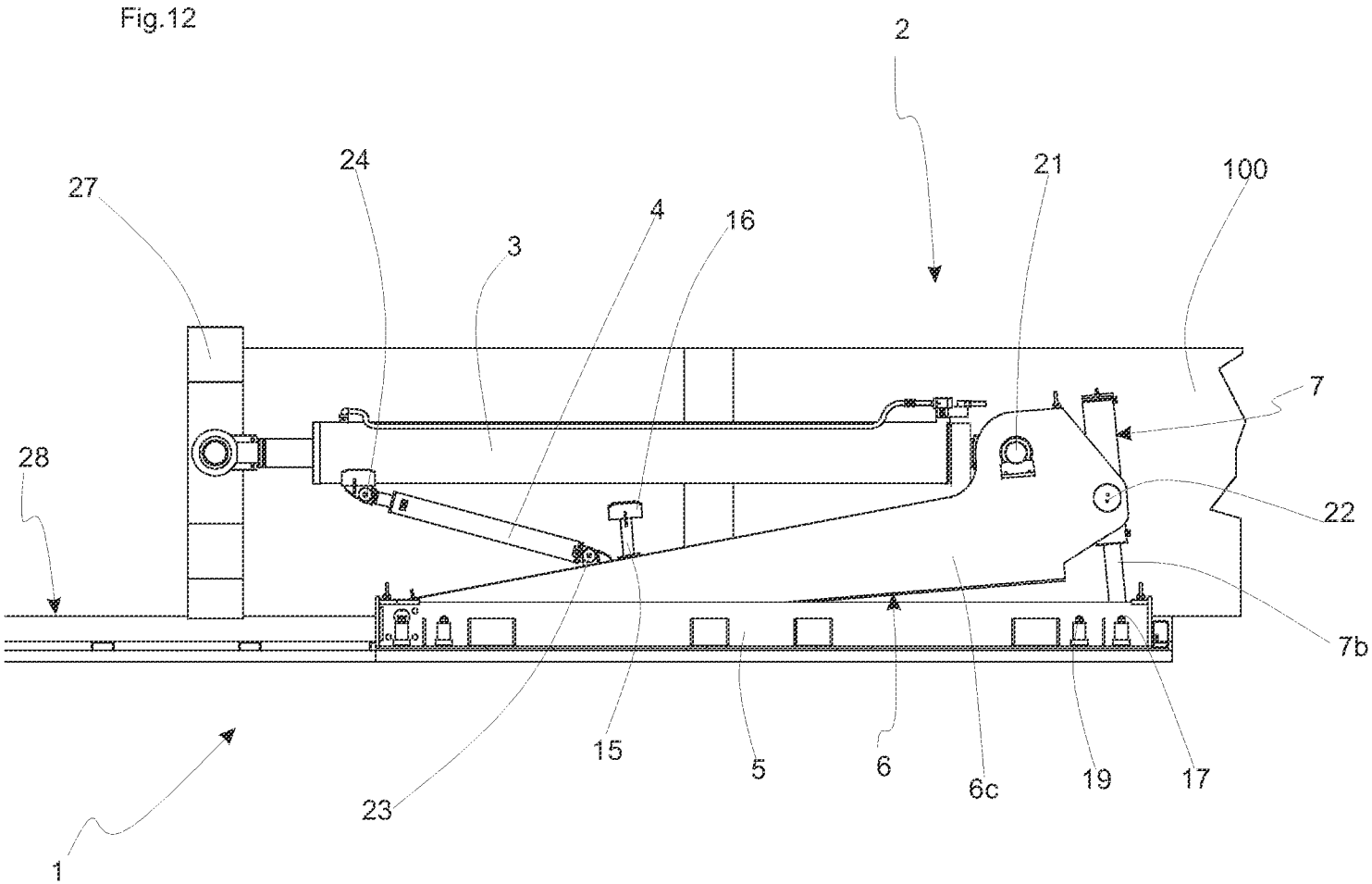
FIG. 12: shows an elevation view of the device in the configuration for pushing or pulling concrete tubes.
Figure 13:
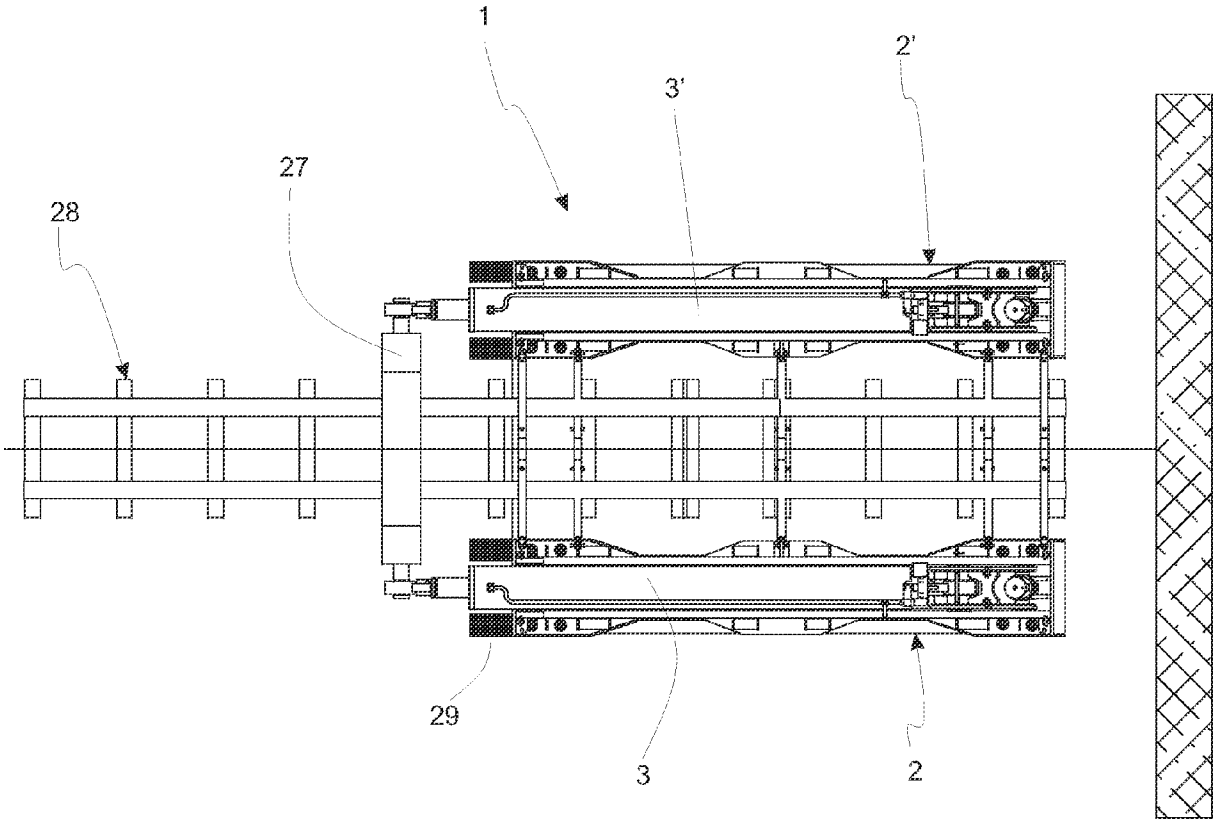
FIG. 13: shows a plan view of the device in FIG. 12.

Particularly referring to FIGS. 12 and 13, a second exemplary embodiment of device 1 provides adopting a thrust ring 27, instead of vice 8, and a horizontal translation system 28, such as a rail disposed between the two bases 5 and 5', with an axis corresponding to the axis of concrete tube 100, after having eliminated opposing roller 10. As shown in FIG. 13, to hold device 1 in the correct position and to avoid displacements, opposing blocks 29 are provided.

The invention claimed is:

1. A device for applying a push or pull action on tubes to be laid in a ground for overcoming waterways or other obstacles, comprising:

two push blocks placed parallel to and mirroring each other;

a vice which couples the device to a tube to be pushed/pulled, each push block comprising a base, at least one main cylinder which carries out the push/pull action of the tube, and at least one positioning cylinder hinged on one side to said main cylinder and imparting an angle to said main cylinder;

at least one movable arm interposed between the base and the at least one main cylinder, said at least one movable arm being connected to the base by of at least one pin, around which the at least one movable arm is free to rotate;

at least one vertical regulation cylinder configured to move the movable arm;

an opposing roller assembly between the two push blocks and, said opposing roller assembly being fixable and is placed orthogonally to longitudinal axis of the base and hinged to the at least one movable arm at hinge points;

said at least one movable arm in combination with the at least one positioning cylinder and with vertical regulation cylinders conferring a variable geometry to the device which is able to automatically assume innumerable varying angles combined with innumerable varying elevations with respect to a horizontal work axis; and the vertical regulation cylinders are fixable to the at least one movable arm by containment bands adapted to fix jackets of vertical regulation cylinders to the at least one movable arm themselves, said containment bands being connected to the at least one movable arm by hooks arranged on lateral plates of the at least one movable arm.

2. The device according to claim 1, the at least one movable arm is box-like and essentially L-shaped, formed by an upper base and a lower base and by lateral plates and parallel plates.

3. The device according to claim 2, wherein the at least one positioning is disposed between arms of the at least one movable arm, and cylinders of the at least one main cylinder are hinged to upper bases of the at least one movable arm at hinge points on one side, and at hinge points in a part below jackets of the cylinders of the at least one main cylinder on the other.

4. The device according to claim 1, wherein positive angles have values in a range between 0° and +90°, while negative angles range from 0° to −20°.

5. The device according to claim 1, wherein at ⅓ of a length of upper bases of arms of the at least one movable arm, vertical rods are fixable, each vertical rod bearing a plate on which the at least one main cylinder abutted; said at least one main cylinder being hinged at hinge points of the at least one movable arm.

6. The device according to claim 1, wherein the base comprises bases that are joined by a plurality of crosspieces which connect sides of the bases themselves.

7. The device according to claim 1, wherein the at least one main cylinder supports the vice to which they are fixed by locking pins.

* * * * *